US007748067B2

(12) United States Patent
Altinier et al.

(10) Patent No.: US 7,748,067 B2
(45) Date of Patent: Jul. 6, 2010

(54) HOUSEHOLD LAUNDRY WASHING MACHINE WITH IMPROVED SPINNING PHASE

(75) Inventors: Fabio Altinier, Porcia (IT); Stefano Galassi, Porcia (IT); Marco Giovagnoni, Udine (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 12/371,221

(22) Filed: Feb. 13, 2009

(65) Prior Publication Data

US 2009/0151085 A1 Jun. 18, 2009

Related U.S. Application Data

(62) Division of application No. 11/140,393, filed on May 27, 2005, now abandoned.

(30) Foreign Application Priority Data

Jun. 24, 2004 (EP) ..... 04102927

(51) Int. Cl.
*D06F 35/00* (2006.01)

(52) U.S. Cl. ..... 8/158

(58) Field of Classification Search ..... 8/158
See application file for complete search history.

(56) References Cited

U.S. PATENT DOCUMENTS 6,418,581 B1 * 7/2002 Bruce et al. ..... 8/159
2003/0140427 A1 * 7/2003 Yamamoto et al. ..... 8/159

FOREIGN PATENT DOCUMENTS

| | | |
|---|---|---|
| EP | 0335790 | 10/1989 |
| EP | 1342826 | 9/2003 |
| FR | 2577949 | 8/1986 |

* cited by examiner

*Primary Examiner*—Frankie L Stinson
*Assistant Examiner*—Samuel A Waldbaum
(74) *Attorney, Agent, or Firm*—Pearne & Gordon LLP

(57) ABSTRACT

Provided is a method of minimizing an unbalanced load of laundry within a clothes laundering machine before a high-speed spinning phase. The method includes rotating a drum of the clothes laundering machine at a suitable rotational speed to initially retain at least a portion of the laundry within the drum against an inner surface of the drum; and determining that an unbalanced distribution of the laundry exists within the drum. In response to determining that the unbalanced distribution of laundry exists within the drum, initiating a laundry distribution phase to redistribute the laundry within the drum to reduce at least one of the unbalance mass to a level that is less than or equal to a maximum allowable mass value, and the elevation torque to a level that is less than or equal to a maximum allowable elevation torque. The laundry distribution phase includes decelerating the rotational speed of the drum to a reduced speed that allows at least a portion of the laundry retained against the inner surface of the drum to separate from the inner surface of the drum to be re-distributed within the drum, and subsequent to said decelerating, accelerating the rotational speed of the drum to a suitable speed that is greater than the reduced speed for retaining the re-distributed portion of the laundry against the inner surface of the drum.

14 Claims, 5 Drawing Sheets

LEGEND

| | |
|---|---|
| $\omega$ | REFERENCE DRUM SPEED |
| $\omega_{MAIN}$ | MAIN AGS SPEED |
| $\Delta\omega$ | SPEED VARIATION DURING ACCELERATION OR DECELERATION |
| $J_{TOTAL}$ | INERTIA OF DRUM PLUS LAUNDRY PLUS MOTOR |
| $T_{FRICTION}$ | FRICTION TORQUE |
| $T_{ELEVATION}$ | ELEVATION TORQUE |
| $T^{MAX}_{ELEVATION}$ | MAXIMUM ACCEPTABLE AMPLITUDE OF ELEVATION TORQUE |
| m | UNBALANCE MASS |
| S | MAXIMUM ACCEPTABLE VALUE FOR THE UNBALANCE MASS |
| $\beta$ | MULTIPLICATION FACTOR |
| $\Delta T$ | SAMPLE TIME |

FIG. 1B

LEGEND

| | |
|---|---|
| $\omega$ | REFERENCE DRUM SPEED |
| $\omega_{MAIN}$ | MAIN AGS SPEED |
| $\omega_{MAXd}$ | MAXIMUM DISTRIBUTION SPEED |
| $\omega_{MINd}$ | MINIMUM DISTRIBUTION SPEED |
| $\Delta\omega$ | SPEED VARIATION DURING ACCELERATION OR DECELERATION |
| $J_{TOTAL}$ | INERTIA OF DRUM PLUS LAUNDRY PLUS MOTOR |
| $T_{FRICTION}$ | FRICTION TORQUE |
| $T_{ELEVATION}$ | ELEVATION TORQUE |
| $T^{MAX}_{ELEVATION}$ | MAXIMUM ACCEPTABLE AMPLITUDE OF ELEVATION TORQUE |
| m | UNBALANCE MASS |
| S | MAXIMUM ACCEPTABLE VALUE FOR THE UNBALANCE MASS |
| $\beta$ | MULTIPLICATION FACTOR |
| t | TIME |
| $t_M$ | MAXIMUM COMPUTATION TIME |
| $\Delta T$ | SAMPLE TIME |
| N | NUMBER OF SUCCESSIVE FAVORABLE EVENTS |

FIG. 2C

HOUSEHOLD LAUNDRY WASHING MACHINE WITH IMPROVED SPINNING PHASE

CROSS-REFERENCE TO RELATED APPLICATIONS

This application is a divisional of U.S. application Ser. No. 11/140,393, filed on May 27, 2005 now abandoned which claims the benefit of European application Serial No. 04 102 927.3, filed on Jun. 24, 2004. These applications are incorporated in their entirety herein by reference.

The present invention relates to a laundry washing or to a laundry washing-dryer machine provided with means able to detect the unbalance mass and to balance the laundry load before the spinning phase.

It is well known during an operating program of laundry washing/drying machine to have one or more spinning phases, i.e. drum rotation phases at much higher speed than normally foreseen during the actual washing phases.

A basic element concerning said spinning phases is the risk of having an unbalanced laundry load with the clothes arranged unevenly inside the machine drum, i.e. accumulated in some definite areas and not available in other areas, so that during high speed rotation of the drum this unbalanced load condition may in fact cause remarkable oscillations or even the risk of a mechanical failure.

To this purpose the presently available washing machines (or washing-dryer machine) are provided with special control systems and methods to check whether the laundry load is evenly distributed or balanced inside the drum before the execution of the spinning phase, whereas in case of an unbalanced load the control system will remove the unbalance condition and provide for a new distribution phase or at least bring its amount back to acceptable limits to the machine structure.

The techniques to achieve this goal are mainly based on measuring the variation of the drum speed during the starting time of the spinning phase, and on correlating said speed variation to the unbalance level.

Indeed in a drum with an unbalanced load, moving at a constant rotation speed, the presence of an unbalanced load causes an increase in the drum speed in the time interval when the load is in the descending phase, and causes it to slow down when it is in the ascending phase.

As a result the drum speed takes an oscillatory behaviour around an average speed, well known to the man skilled in the art, and that for the sake of brevity is no further described.

According to the prior art, as in the exemplary patents EP 1342826, EP 0335790B1 and FR 2577949, such an oscillatory speed behaviour is then detected, processed and used in order to generate some procedures of drum rotation aimed to avoid or reduce the detected unbalance mass.

However said solution shows some drawbacks mainly based on the fact that the inertia moment of the loaded drum is not detected and then not considered in the processing and balancing procedure.

The inertia moment is however most important as it is well known that it directly affects the drum oscillation during the spinning phase; indeed in a drum having an unbalanced load, if the overall drum inertia is increased, i.e. if the laundry load is increased, the resulting oscillation during the spinning phase is reduced accordingly.

And on the contrary, if the inertia moment is reduced, that is if the laundry load is partly removed from the drum, maintaining the initial unbalance mass, then the speed oscillation increases.

Therefore some specific conditions can come true, wherein during the spinning phase the drum is subjected to an excessive oscillations that are prejudicial to the machine safety, even if an acceptable unbalance mass still exists.

A further method to control the unbalance mass is to directly measure the same unbalance mass, i.e. to measure the vibrations of the washing group by using one or more accelerometers.

Based on the measured values, a procedure is started which is aimed to redistribute the load according to known methods.

However this solution requires a not negligible computing power, expensive additional sensors, and moreover the unbalance mass evaluation can be done, with adequate confidence, only when the drum speed is so high that the laundry load is retained on the drum inner surface.

Largely known in the art is a different technique of controlling within proper limits the drum unbalance mass, and consisting in directly counterbalancing said unbalance mass; said technique is implemented by using adequate and generally circular conduits placed solidly with the drum and that are coaxial with it, and that contain some rotating or floating masses, typically water, or oil, or rollers or spheres; said masses are made to rotate by the drum rotation and soon they tend to distribute themselves in their own accord in a respective position able to at least partially balance the unbalance mass of the laundry load contained in the drum.

Said solutions are exemplified in the European patent appl. n. 96114328.6, in WO 93/23687 and also in the patents therein cited.

Said solutions of automatic re-balancing have shown effective from a functional point of view, but also burdensome and complicated in the construction, and furthermore they are also degrading the performances as the annular chambers, containing the balancing masses, take up a room that otherwise could have be taken by the laundry articles.

It would therefore be desirable, and is actually a main purpose of the present invention, to provide a clothes washing or washing-drying machine that will eliminate, or at least reduce the drawback of the unbalance mass produced by the uneven laundry distribution inside the drum during the spinning phases at high speed, considering also the actual inertia of the arm containing the laundry load.

According to a further purpose of the present invention this clothes washing machine (or washing-dryer machine) shall be able to be easy manufactured by using existing, ready available materials and techniques, and be competitive in its construction without suffering any alteration or reduction in the performance and reliability thereof.

These aims are reached in a washing machine (or in a washing-dryer machine) incorporating the characteristics as recited in the appended claims and including such operating modes as described below by mere way of non-limiting example with reference to the accompanying figures, in which:

GENERAL PRINCIPLES

Figure 1A:
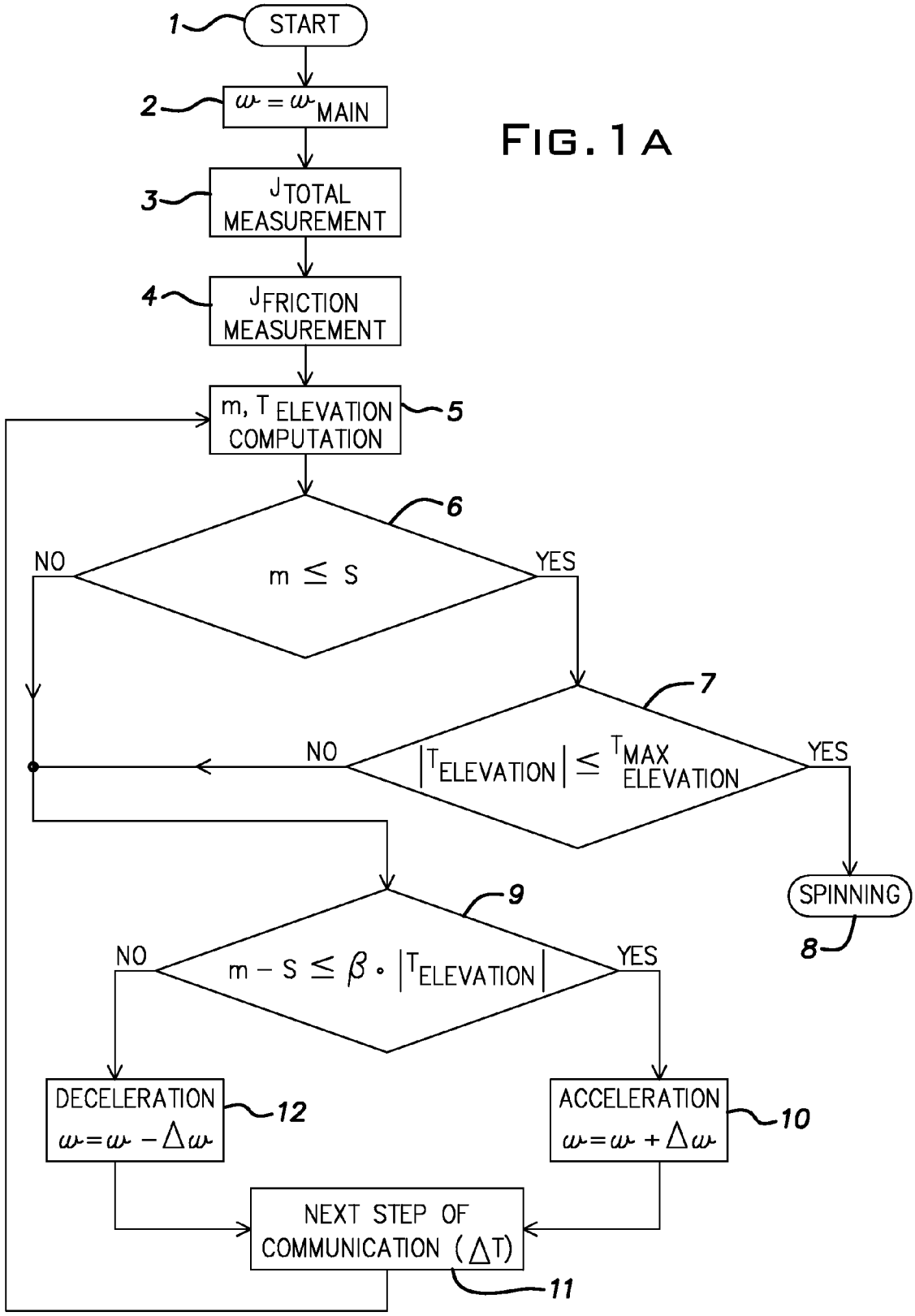
FIG. 1 is a simplified flow-chart of the basic operations and logical checks in a washing machine (or washing-dryer machine) according to the invention.

The requirements of the distribution strategy according to the instant invention are now generally described, and the description of the operating modes and of the computations, aimed to define the needed parameters, are deferred further on.

In order to obtain a good balance of the laundry load it is needed:

to measure its unbalance mass, and, to find out the best distribution strategy.

As well known, the unbalance mass can be calculated from the static laundry unbalance mass; said static unbalance mass can be measured by making an energy balance on an integer number of drum turns.

Therefore an initial measurement of the inertia moment of the total drum (comprising drum, the whole laundry load and the motor), and the continuous measurements (i.e. lasting for the whole time interval of the distribution process) of the angular drum speed and of the motor torque have to be carried out.

In order to obtain a good balance of the laundry load it is needed to find out the best distribution strategy according to the unbalance mass, which of course can be varying during the spinning starting phase; moreover the said distribution strategy has to be able of automatically changing itself according to the changing of the unbalance mass.

The laundry movement inside the drum is random, not foreseeable and in the facts not controllable from the outside; then, if a favourable situation takes place, it is advisable to try to freeze it as quick as possible, by increasing the rotation speed.

From this point of view it is then useful to drive the drum at a suitably high speed, so that the laundry load is fully retained on the drum inner surface.

On the other side, with the increase of the rotation speed, the portion of the laundry load not yet retained against the drum inner surface tends to decrease, and that may prevent the reduction of the unbalance mass in excess with respect to the maximum allowed value for the unbalance mass.

As a conclusion, the speed control during the laundry distribution process has to duly take into account said two clashed elements; practically speaking, the rotational speed must be controlled in such a way to be the highest possibly, having taken into account that the possibility of eliminating the unbalance mass in excess (with respect to the maximum acceptable unbalance degree) shall not be excluded.

The requirements of the distribution strategy according to the instant invention are now explained.

DEFINITIONS

The general equilibrium equation with reference to the rotational speed of the drum with the laundry load is:

$$J_{TOTAL} \cdot \frac{d\omega}{dt} = -mgR \cdot \cos(\omega t) + T_{MOTOR} + T_{FRICTION} + T_{ELEVATION}$$

wherein the various terms show the respective following meanings:

$J_{TOTAL}$ is the total inertia of the rotating masses, comprising the laundry load, the drum and the electric motor, respect to the drum axis.

$\omega$ is the drum angular speed.

m is the static unbalance mass.

$d\omega/dt$ is the drum angular acceleration.

g is the gravity acceleration.

R is the drum radius.

$-mgR\cdot\cos(\omega t)$ is the resistant moment due to the static unbalance mass m (it is an oscillatory value).

$T_{MOTOR}$ is the torque provided by the electric motor and measured on the drum axis.

$T_{FRICTION}$ is the friction torque measured on the drum axis.

$T_{ELEVATION}$ is the torque, measured on the drum axis, needed to raise the portion of the laundry load that is not yet retained on the drum inner surface, without the friction effect and of the inertial effect.

The overall inertia on the drum axis ($J_{TOTAL}$) must be measured once and for all at the beginning of the laundry distribution process, as it is a value that is stable, when the laundry humidity is constant.

The friction torque on the drum axis ($T_{FRICTION}$) takes into account all the frictions developed by the machine, comprising both the ball bearings and the gear friction, and those related to the laundry rubbing.

The elevation torque on the drum axis ($T_{ELEVATION}$) is the resistant torque due to the laundry not yet retained by the centrifugal force on the drum inner surface; indeed in its downwards motion the not yet retained laundry doesn't make any resisting torque, as it doesn't drags the drum with it, while it makes a restraining torque in its upwards motion.

The energy supplied by the motor to raise the laundry is then dispersed by friction in the warping motion of the laundry load (falling impact and rubbing due to the relative motion among the laundry articles). The elevation torque is then a negative moment, as the friction torque is.

The parameters used in the distributing procedure are the static unbalance mass (m) and the elevation torque ($T_{ELEVATION}$).

They can be obtained by using the given general equation to calculate an energy balance over an integer number of drum turns. Therefore an integration of the same equation between an initial angle $\theta_1$ and a final angle $\theta_2=\theta_1+2\pi N$, has to be calculated, N being an integer number.

As the resistant torque generated by the static unbalance mass $-mgR\cdot\cos(\omega t)$ shows a sinusoidal behaviour with respect to the drum rotation angle, then the unbalance mass amount can be estimated by the following equation, valid for any initial angle $\theta_1$:

$$\int_{\theta_1}^{\theta_1+2\pi} |-mgR\cos\theta| d\theta = 4mgR$$

In order to use the main equation that allows the instantaneous determination of the amount of the unbalance mass (m) and of the elevation torque ($T_{ELEVATION}$), it is requested to measure two parameters: the drum angular speed ($\omega$), and the motor torque ($T_{MOTOR}$).

However here it is intended that the relevant amounts are well known, as they can be easily detectable with known means and procedures; for instance by using a tachometer generator and measuring the current taken up by the motor, with respect to its phase; therefore their measurements and processing are no further discussed.

Distribution Strategy of the Laundry Load

The elevation torque ($T_{ELEVATION}$) can be referred as the parameter of the percentage of the laundry load not retained to the inner wall of the drum; if said moment is zero, the laundry articles are fully retained on the drum inner surface, while as much this parameter increases in its absolute amount (being it a negative amount) as the laundry load is allowed to move itself.

By using the correlation between the elevation torque and the mobility degree of the laundry load, it is possible to define an advantageous and effective strategy for the distribution process.

According to the above considerations, the procedure for starting the spinning phase without suffering an excessive unbalance mass will have to consider the following observations:

- The laundry motion inside the drum is a random and not foreseeable movement, and in fact not controllable from the outside.
- The only thing that can be done is to wait that a condition of low unbalance mass takes place.
- If a favourable condition takes place, it is requested to freeze it as quick as possible, by increasing the rotation speed.
- The higher is the rotation speed, the easier is the freezing of a favourable condition when it takes place.
- The lower is the rotation speed, the higher is the laundry mobility degree, i.e. the load percentage not retained in a substantially fixed position related to the drum.
- In order that a favourable condition can take place, it is requested that the laundry can be moved with a basically high mobility degree, so that the possibility of eliminating the unbalance mass in excess (with respect to the maximum accepted unbalance degree) is not preliminarily excluded.

If all these facts are taken into account, it is concluded that the best distribution strategy consists in the adoption of a rotating drum speed during the whole distribution phase that be the maximum possible speed, however compatible with a laundry mobility degree good enough to allow the possibility of eliminating the unbalance mass in excess measured each time.

In order to implement such strategy and in order to control properly the target speed during the distribution process, the following condition must be implemented:

$$m-S<\beta\cdot|T_{ELEVATION}|$$

In it, m represents the static unbalance mass measured at the actual time, while S gives the threshold, i.e. the maximum allowed limit for the unbalance mass; therefore m−S represents the unbalance mass in excess that is requested to compensate.

β is a suitably selected constant value.

If the check of the above given condition is positive (the condition is true), that means that the laundry articles have not been fully distributed on the drum wall, but a part of them are still "flying" inside it, due to the fact that the drum speed is too low. Therefore a limited increase of the drum speed is activated.

If the check of the above condition is negative, (the condition is not true), that means that the unbalance mass is too high, independently of the fact that the laundry articles are or not retained on the drum inner wall. Then a small decrease in the drum speed is activated, in order to separate a further portion of the laundry load from the drum inner wall and to reposition it in a more balanced way.

The optimum condition, that permits to start the spinning phase with a well balanced load, is implemented when the unbalance mass is low enough and, in the same time, the elevation torque is close enough to zero, (i.e. when the laundry load appears to be well distributed in the drum and with a left-over mobility close to zero).

That means that the following two conditions have to come true:

$$\begin{cases} m \le S \\ |T_{ELEVATION}| \le T_{ELEVATION}^{MAX} \end{cases}$$

where $T_{ELEVATION}^{MAX}$ is the maximum allowable amount for the absolute value of the elevation torque.

As a matter of facts, the distribution strategy must consist in that the spinning phase is allowed only after two basic conditions are implemented, i.e.:

- COND 1: the unbalance mass must be less than a maximum pre-determined value, and it has to be measured just before of starting the spinning phase, i.e. when:
- COND 2: the whole laundry load is almost fully distributed on the drum inner wall, that is the elevation torque is less than a maximum predefined amount.

Such strategy can be effectively understood, in the actual case of a washing machine (or a washing-dryer machine) just before the spinning phase, considering the logical flow-chart of FIG. 1, representing in a simplified form the operating sequence of the various logical and control operations in a washing machine (or in a washing-dryer machine) according to the invention.

Figure 2A:
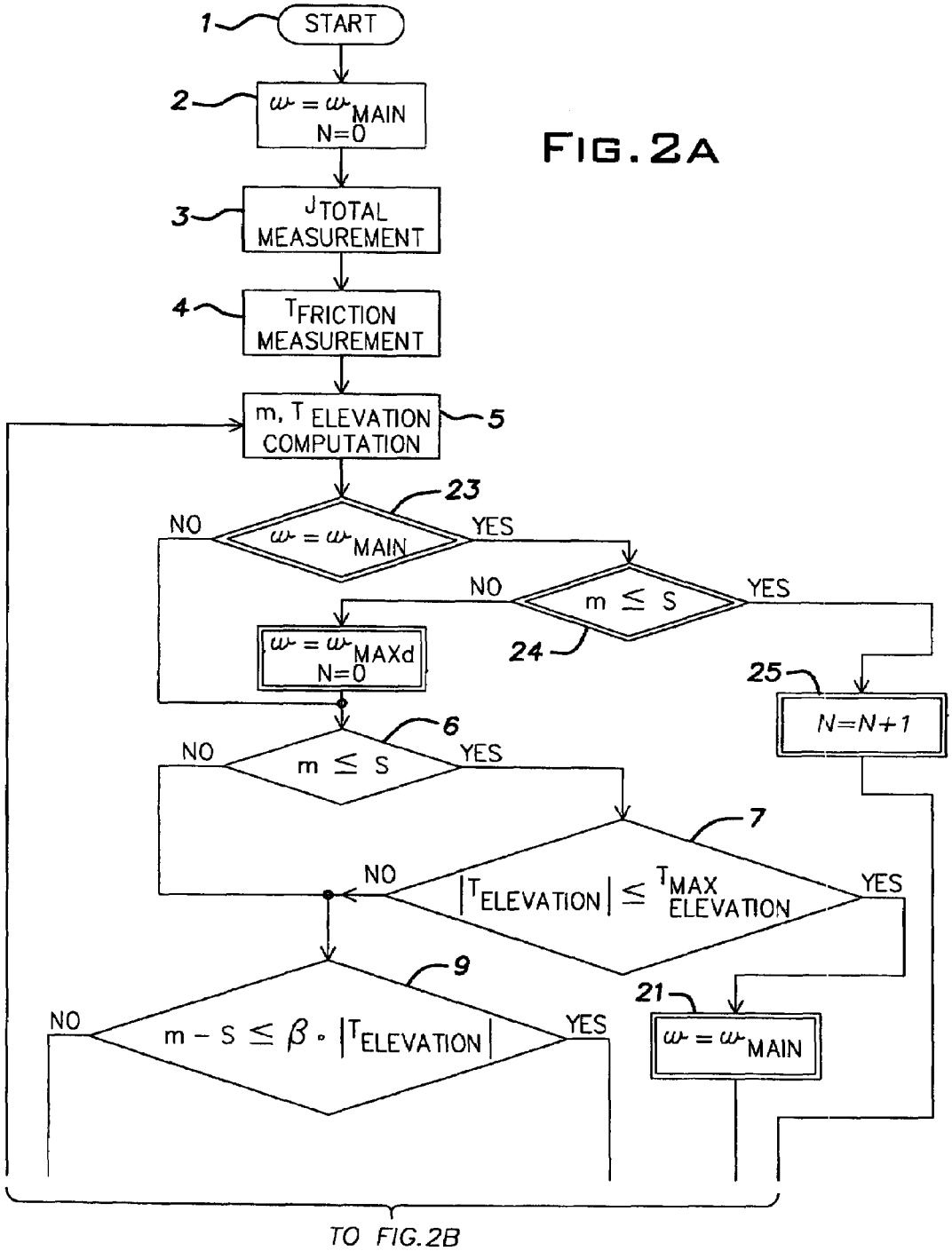
FIG. 2 is a complete flow-chart of the basic operations and logical checks in a washing machine (or washing-dryer machine) according to the invention.
Figure 2B:
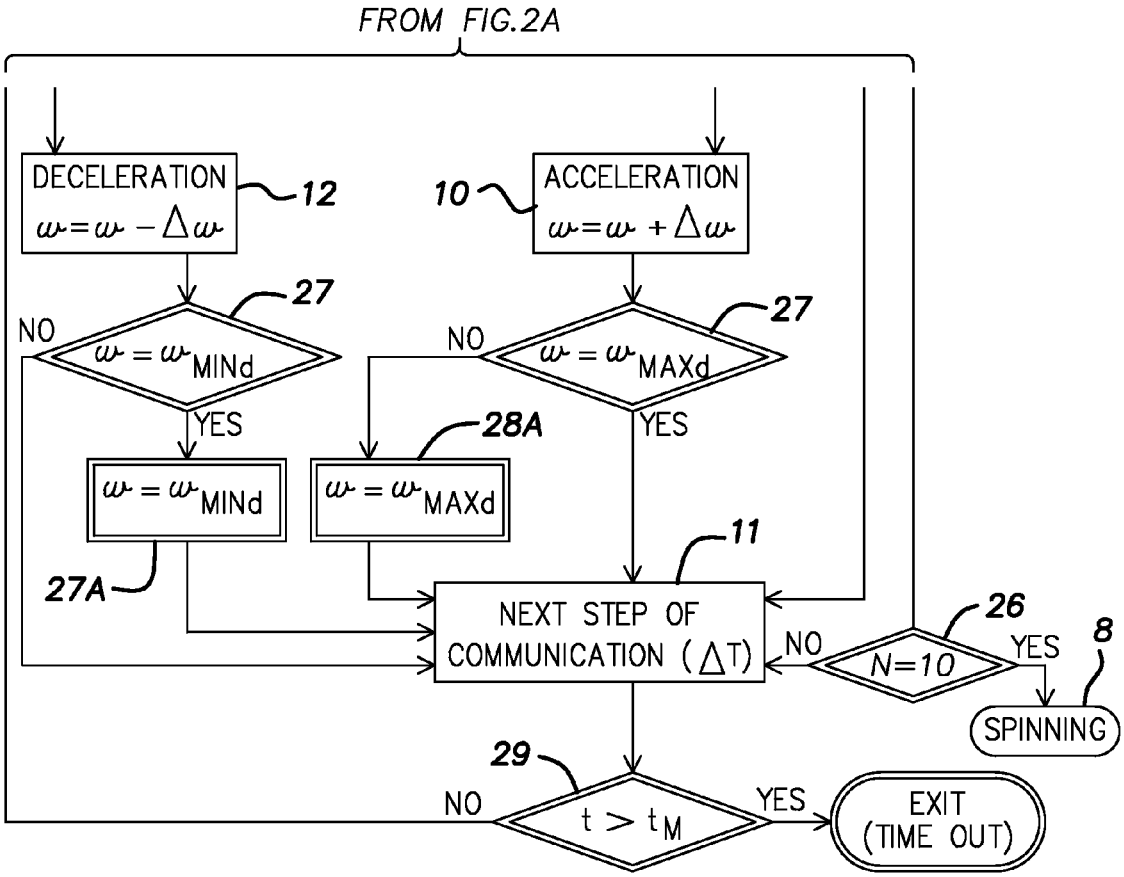

In order to simplify and to make easier the understanding of the invention, said logical flow-chart shows only the working modes of a logical and working kind that are essential to implement the invention; in the real situation however of a washing machine (or a washing-dryer machine) that actually implements the invention, it is needed and useful to introduce some further operations and logical functions; these are described in FIG. 2 which represents all working operations and functions in a washing machine for actual use.

In the flow-chart of FIG. 1 each block is identified by a specific number, that is used in the following description in order to describe the operation modes of the respective blocks:

- Block 1. The spinning phase is started; in said phase the motor is activated so that it speeds-up the drum speed till to a pre-determined speed.
- Block 2. Said pre-determined speed $\omega_{MAIN}$ is reached; said speed is the minimum speed when the laundry load is wholly distributed on the drum inner surface; usually said speed is around 110 rpm.
- Block 3. The measurement of the inertia moment $J_{TOTAL}$ of the drum, comprised of the laundry load, is done; the measurement of said value can be easily calculated with known means and procedures, for instance by the detection of the torque and of the drum angular acceleration; as these operations are well known in the prior art, they are not further explained.
- Block 4. The average friction torque on one turn ($T_{FRICTION}$) in the condition where the laundry load is retained on the drum inner surface is measured; it corresponds (but the sign) to the average torque supplied by the motor and needed to exceed the friction in condition of stable target speed, the laundry being retained by the drum.

Block 5. The unbalance mass m and the elevation torque $T_{ELEVATION}$ are calculated; the two parameters are now calculated at the actual speed that usually is different from the speed in the previous block 4, as the latter speed has been modified by the loop comprising the block 11 described further on, wherein the actual speed has been accelerated or decelerated by a limited amount.

Block 6. In this block the test is done whether the unbalance mass m is less than a pre-defined value S; if such test is confirmed, the operation goes on to the following step in the block 7; said first check is a basic step, as it implements the first of the two conditions seen above (COND 1).

Block 7. In this logical block the test is done whether the module of the elevation torque $T_{ELEVATION}$ is less than a maximum specified value $T_{ELEVATION}^{MAX}$; this second test implements the second condition given above (COND 2).

Block 8. If said second condition too is confirmed, the spinning phase is started without further tests, measures and/or calculations, as the two conditions required of a small and acceptable unbalance mass, combined with a fairly even distribution of the laundry load on the drum inner surface, are accomplished.

Block 9. If, on the contrary, in the logical block 6 the unbalance mass m is not less than the specified limit value S, or if at the logical block 7 the elevation torque $T_{ELEVATION}$ is not less than the respective specified maximum value, that means that at least one of the two main conditions (COND 1, or COND 2) are not met; therefore it is needed to work out the logical operation of checking whether $m-S<\beta\cdot|T_{ELEVATION}|$, wherein β is a properly defined constant. If such test is met, it means that the laundry is not completely distributed on the drum inner surface, but is still "flying" into it, obviously due to the fact that the drum speed is too low. In order to overcome such problem the operation goes on to the following block 10.

Block 10. In said block a small step-up of a predetermined amount is actuated on the drum speed, of course in order to make the laundry to better adhere to the drum inner surface.

Block 11. After the drum speed variations, the routine of the calculations and of the related tests, previously described in the logical block 5 on, is initiated until the condition in block 7 is met, so that it is now possible to start the spinning phase.

Block 12. If in the previous block 9 the given condition is not met, that means that the unbalance mass is excessive, independently of the fact that the laundry load is or not adhering to the drum inner surface; in order to overcome such constraint, a reduction of a predetermined amount is activated on the drum speed, to allow that the load into the drum is separated and is re-distributed in a more even way; of course that can be not obtained in the first attempt, but this result can be easily attained with a sequence of different attempts at progressively lower speeds, as activated by the logical loop going from the block 11 towards the block 5.

The flow-chart of FIG. 1 is effective to illustrate the logical and functional ground of the invention; however in an actual washing machine (or washing-dryer machine), intended for a real household use, it is needed to introduce in the working process a number of further checks in order to make it safer and that in any case determine some limit values, beyond which the washing cycle is stopped in any case.

With reference to FIG. 2, a second flow chart is showed which comprises the flow chart of FIG. 1, but it introduces some new logical and operating blocks.

The blocks of FIG. 2 having the same functions of the blocks of FIG. 1 are here numbered with the same numbers from 1 to 11; the new blocks are here numbered from 21 to 29 (however some numbers are missing).

Moreover the new blocks are easily recognized as their external perimeter is highlighted with a double line.

Now the meanings of the main blocks that have been added is explained shortly, as the reasons of their presence and the related working modes is easily guessed and understood by the man skilled in the art.

Block 21. After the checks in the previous blocks 6 and 7, this operation assures the restoring of the speed condition that is the same as in the block 2, i.e. wherein the laundry load is fully distributed on the inner drum wall; it is a mandatory condition for the spinning phase.

Block 29. $t<t_M$: it means that each time the recalculation loop addresses back to block 5, a check of the operating mode is done to verify that the total execution of the program is not longer than a maximum pre-defined time interval; as a matter of fact it can happen that, observing FIG. 1, the washing machine (or washing-dryer machine) is never launched into spinning but it goes on working endless according to the closed loop 5-6-9-10, or 12-11-5.

Block 27 and 27A. $\omega\leqq\omega_{MINd}$: it means that, should the speed attained by the foreseen deceleration be lower than a minimum pre-defined limit, then the reestablishment to said minimum speed $\omega_{MINd}$ is determined.

Block 28 and 28A. $\omega\leqq\omega_{MAXd}$: it means that, should the speed attained by the foreseen deceleration be higher than a maximum pre-defined limit, then the reestablishment to said maximum speed $\omega_{MAXd}$ is determined.

Block 23. It is checked whether the drum speed is the same drum speed $\omega_{MAIN}$ in block 2; it is used as a preparatory phase of the spanning phase, and in this phase the drum speed must be such to allow the complete distribution of the laundry load on the inner drum wall.

Block 24. This block too is a check phase before spinning; it is verified that in the preliminary phase the unbalance mass be low enough. It can be considered a repetition of the verification of block 6, but as a matter of facts the latter is an absolutely needed check to implement the instant invention, as the check in block 24 is an operation intended to increase the confidence for a correct operation. There is no need to check here that the amount of the elevation torque be low enough as, at the present speed, the laundry load is practically retained by the drum wall.

Block 25. It is a counting register; it counts number of times the check in block 24 has given a consent for spinning. As to the sampling frequency of the measurements, and so of the checks done, it may advantageously be around 50 times/sec. If said checks are performed for instance N=10 times as represented, it turns out that only 0.2 seconds are requested to verify, with a reliable number of times, that all the given conditions, i.e. the load balance, the laundry distribution and the drum speed are suitable to start the drum into spinning.

Figure 3:
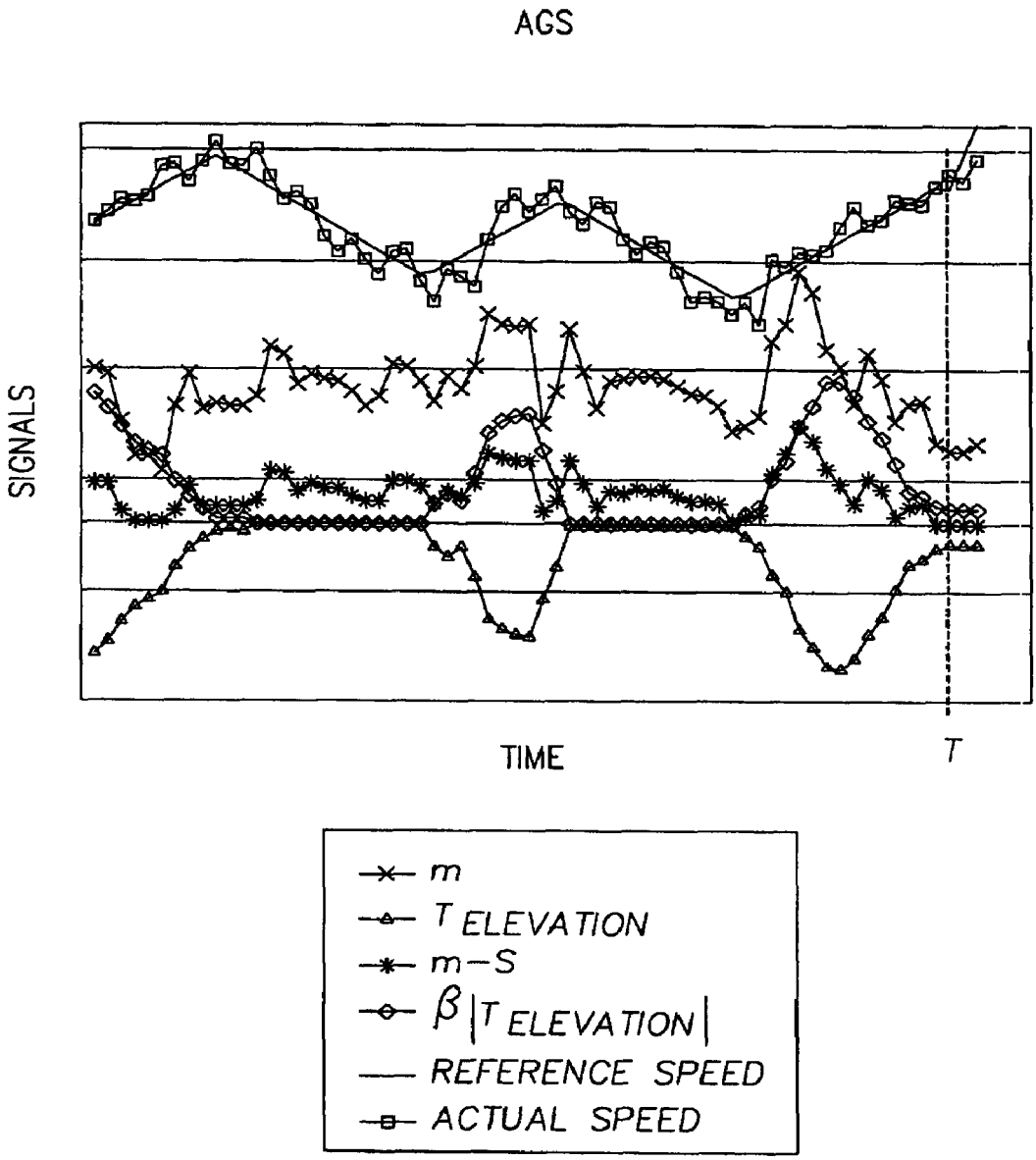
FIG. 3 is a diagram of a number of electrical signals representing various parameters in a washing machine (or washing-dryer machine) working according to the flow chart of FIG. 2.

With reference to FIG. 3, the behaviour of the various parameters measured and calculated in an actual working cycle can be observed; it has to be precisely noticed that the drum actual speed follows very closely the target speed, that to its turn shows a saw-tooth profile, being the speed determined by the cited iterative process of acceleration/deceleration that is continuously implemented and updated (within maximum time limits that have been already explained), according to what determined in the blocks 10 and 12.

It is then apparent that the instantaneous speed basically follows the progress of said target speed, as it is the latter which controls the time by time motor working.

Moreover it is to be noticed that at a certain time, T in the diagram, the actual speed tends to increase beyond its previous average amounts; in the facts at this time the spinning phase is started, as the two conditions 1 and 2, previously described, have been met.

It can be immediately verified that, at that time, the unbalance mass m takes its minimum amount and, in the same time, the elevation torque takes its minimum amount, in its absolute value.

The invention claimed is:

1. A method of minimizing an unbalanced load of laundry within a clothes laundering machine before a high-speed spinning phase, the clothes laundering machine comprising a drum in which clothing is to be laundered and being adapted to initiate a drum speed acceleration, a drum speed deceleration, and a combination of a drum speed acceleration and a drum speed deceleration in response to detecting a distribution condition within the drum, the method comprising:

rotating the drum of the clothes laundering machine at a suitable rotational speed ($\omega_{MAIN}$) to initially retain at least a portion of the laundry within the drum against an inner surface of the drum;

determining that the distribution condition exists within the drum when at least one of the following conditions is satisfied:

an unbalance mass (m) is greater than a maximum allowable mass value (S); and an elevation torque ($T_{ELEVATION}$) is greater than a maximum allowable elevation torque ($T_{ELEVATION}^{MAX}$); and in response to said determining, initiating a distribution control phase to establish:

a value of the unbalance mass (m) that is less than or equal to the maximum allowable mass value (S), and a value of the elevation torque ($T_{ELEVATION}$) that is less than or equal to the maximum allowable elevation torque ($T_{ELEVATION}^{MAX}$), wherein the distribution control phase comprises at least one of:

the drum speed acceleration, the drum speed deceleration, or the combination of the drum speed acceleration and the drum speed deceleration initiated by the clothes laundering machine to bring about a desired distribution of laundry within the drum before a high-speed spinning phase is initiated, responsive to said determining that the distribution condition exists, calculating a difference between the unbalance mass (m) and the maximum allowable mass value (S); and if the difference is less than a predetermined limit that is established as a function of the elevation torque ($T_{ELEVATION}$), accelerating the rotational speed of the drum by a predetermined speed increase.

2. The method according to claim 1, wherein determining a value of the unbalance mass (ni) comprises:

measuring a total drum inertia ($J_{TOTAL}$) of the drum and laundry at a beginning of the high-speed spinning phase;

measuring a rotational speed of the drum during the distribution control phase;

measuring a motor torque produced by an electric motor rotating the drum during the distribution control phase; and conducting an energy balance over a predetermined number of drum rotations utilizing the rotational speed of the drum and motor torque that were measured to calculate the unbalance mass (m).

3. The method according to claim 1, wherein determining the elevation torque ($T_{ELEVATION}$) comprises:

measuring a total drum inertia ($J_{TOTAL}$) of the drum and laundry at a beginning of the high-speed spinning phase;

measuring a rotational speed of the drum during the distribution control phase;

measuring a motor torque produced by an electric motor rotating the drum during the distribution control phase; and conducting an energy balance over a predetermined number of drum rotations utilizing the rotational speed of the drum and motor torque to calculate the elevation torque ($T_{ELEVATION}$).

4. The method according to claim 1, wherein the distribution control phase comprises a sequence of drum speed variations including a plurality of drum speed accelerations, a plurality of drum speed decelerations, or a plurality of both drum speed accelerations and drum speed decelerations, wherein said sequence of drum speed variations allows laundry re-distribution and re-positioning steps.

5. The method according to claim 1 further comprising initiating the high-speed spinning phase when both of the following conditions are satisfied:

the unbalance mass (m) is less than or equal to the maximum allowable value (S); and the elevation torque ($T_{ELEVATION}$) is less than or equal to the maximum allowable elevation torque ($T_{ELEVATOR-MAX}$).

6. The method according to claim 1 further comprising:

responsive to determining that the distribution condition exists, calculating a difference between the at least one of said unbalance mass (m) and said maximum allowable value (S); and if said difference is higher than a predetermined limit that is defined as a function of the elevation torque, decelerating the rotational speed of the drum by a predetermined speed reduction.

7. A method of minimizing an unbalanced load of laundry within a clothes laundering machine before a high-speed spinning phase, the clothes laundering machine comprising a drum in which clothing is to be laundered and being adapted to initiate a drum speed acceleration, a drum speed deceleration, and a combination of a drum speed acceleration and a drum speed deceleration in response to detecting a distribution condition within the drum, the method comprising:

rotating the drum of the clothes laundering machine at a suitable rotational speed ($\omega_{max}$) to initially retain at least a portion of the laundry within the drum against an inner surface of the drum;

determining that the distribution condition exists within the drum when at least one of the following conditions is satisfied:

an unbalance mass (m) is greater than a maximum allowable mass value (S); and an elevation torque ($T_{ELEVATION}$) is greater than a maximum allowable elevation torque ($T_{ELEVATION}^{MAX}$); and in response to said determining, initiating a distribution control phase to establish:

a value of the unbalance mass (m) that is less than or equal to the maximum allowable mass value (S), and a value of the elevation torque ($T_{ELEVATION}$) that is less than or equal to the maximum allowable elevation torque ($T_{ELEVATION}^{MAX}$), wherein the distribution control phase comprises at least one of:

the drum speed acceleration, the drum speed deceleration, or the combination of the drum speed acceleration and the drum speed deceleration initiated by the clothes laundering machine to bring about a desired distribution of laundry within the drum before a high-speed spinning phase is initiated before beginning the high-speed spinning phase, establishing the drum rotational speed to a predefined speed ($\omega_{MAIN}$); and subsequent to establishing the drum rotational speed to the predefined speed ($\omega_{MAIN}$), computing an elevation torque and initiating the high-speed spinning phase when:

the static unbalance mass (m) is determined to be no greater than the maximum allowable mass value (S), and an absolute value of the elevation torque is less than the maximum allowable torque ($T_{ELEVATION-MAX}$), wherein said unbalance mass (in) and said elevation torque ($T_{ELEVATION}$) are calculated based on a drum total inertia, and said conditions are checked in times not successive to said calculations.

8. The method according to claim 7 further comprising:

after having established the drum rotational speed, checking whether the drum speed is at said predefined speed ($\omega_{MAIN}$) and said unbalance mass (m) is less than or equal to the maximum allowable mass value (S);

responsive to a positive result to said checking, incrementing a number of said operation in a specific adding register; and if the number in said specific adding register, after having been incremented, is the same as a predetermined number (N), initiating the high-speed spinning phase.

9. A method of minimizing an unbalanced load of laundry within a clothes laundering machine before a high-speed spinning phase, the method comprising:

rotating a drum of the clothes laundering machine at a rotational speed ($\omega_{MAIN}$) that is suitable to initially retain at least a portion of the laundry within the drum against an inner surface of the drum;

determining that a distribution condition exists within the drum when at least one of:

an unbalance mass (m) is greater than a maximum allowable mass value (S); and an elevation torque ($T_{ELEVATION}$) is greater than a maximum allowable elevation torque ($T_{ELEVATION}^{MAX}$); and in response to determining that the distribution condition exists within the drum, initiating a distribution control phase to establish:

a value of the unbalance mass (in) that is less than or equal to the maximum allowable mass value (S), and a value of the elevation torque ($T_{ELEVATION}$) that is less than or equal to the maximum allowable elevation torque ($T_{ELEVATION}^{MAX}$), wherein the distribution control phase comprises accelerating the rotational speed of the drum when a difference between the unbalance mass (in) and the maximum allowable mass value (S) is greater than a predetermined limit that is defined as a function of the elevation torque ($T_{ELEVATION}$), further comprising decelerating the rotational speed of the drum to a reduced speed when the difference between the unbalance mass (m) and the maximum allowable mass value (S) is less than the predetermined limit that is defined as the function of the elevation torque, wherein the reduced speed is slow enough to allow at least a portion of the laundry retained against the inner surface of the drum to separate from the inner surface of the drum and be re-distributed within the drum.

10. The method according to claim 9 further comprising, subsequent to said decelerating, accelerating the rotational speed of the drum to a suitable speed that is greater than the reduced speed for retaining at least a portion of the laundry that was re-distributed against the inner surface of the drum.

11. The method according to claim 9 further comprising initiating the high-speed spinning phase when both:

the unbalance mass (m) is less than the maximum allowable mass value (S); and the elevation torque ($T_{ELEVATION}$) is less than the maximum allowable elevation torque ($T_{ELEVATION}^{MAX}$).

12. The method according to claim 11, wherein the high-speed spinning phase is initiated when the elevation torque ($T_{ELEVATION}$) is substantially zero.

13. A method of minimizing an unbalanced load of laundry within a clothes laundering machine before a high-speed spinning phase, the method comprising:

rotating a drum of the clothes laundering machine at a rotational speed ($\omega_{MAIN}$) that is suitable to initially retain at least a portion of the laundry within the drum against an inner surface of the drum determining that a distribution condition exists within the drum when at least one of:

an unbalance mass (m) is greater than a maximum allowable mass value (S); and an elevation torque ($T_{ELEVATION}$) is greater than a maximum allowable elevation torque ($T_{ELEVATION}^{MAX}$); and in response to determining that the distribution condition exists within the drum, initiating a distribution control phase to establish:

a value of the unbalance mass (in) that is less than or equal to the maximum allowable mass value (S), and a value of the elevation torque ($T_{ELEVATION}$) that is less than or equal to the maximum allowable elevation torque ($T_{ELEVATION}^{MAX}$), wherein the distribution control phase comprises accelerating the rotational speed of the drum when a difference between the unbalance mass (m) and the maximum allowable mass value (S) is greater than a predetermined limit that is defined as a function of the elevation torque ($T_{ELEVATION}$), wherein the predetermined limit is defined as:

$$\beta \cdot |T_{ELEVATION}|$$

wherein β is a constant.

14. The method according to claim 13, wherein the rotational speed of the drum is accelerated when:

$$m-S \leqq \beta \cdot |T_{ELEVATION}|.$$

* * * * *